United States Patent [19]

Lemons et al.

[11] Patent Number: 4,709,691

[45] Date of Patent: Dec. 1, 1987

[54] FULL BODY HYDROMASSAGER HAVING AN ECCENTRIC WEIGHT ROTOR

[76] Inventors: David H. Lemons, 1807 Elkhart Dr., Greensboro, N.C. 27408; George Spector, 233 Broadway, Rm 3615, New York, N.Y. 10007

[21] Appl. No.: 875,939

[22] Filed: Jun. 19, 1986

[51] Int. Cl.[4] ..... A61H 9/00

[52] U.S. Cl. ..... 128/66; 239/383

[58] Field of Search ..... 128/66, 65; 239/102.1, 239/381, 383; 4/596, 601

[56] References Cited

U.S. PATENT DOCUMENTS

| | | | |
|---|---|---|---|
| 3,844,278 | 10/1974 | Weider | 128/66 |
| 4,100,917 | 7/1978 | Talge et al. | 128/66 |
| 4,508,665 | 4/1985 | Spinnett | 128/66 |
| 4,640,462 | 2/1987 | Steams | 128/66 |

FOREIGN PATENT DOCUMENTS

| | | | |
|---|---|---|---|
| 130417 | 10/1900 | Fed. Rep. of Germany | 128/66 |
| 1014584 | 6/1952 | France | 128/66 |

*Primary Examiner*—Edgar S. Burr
*Assistant Examiner*—Tonya Lamb

[57] ABSTRACT

A full body massager apparatus is provided which is activated by water pressure from a plumbing fixture. The apparatus is held in the hand and rubbed over a persons body which is activated by water pressure from a water outlet whereby the water pressure will cause a vigorous vibration massaging effect as water passes through the apparatus over the persons body.

2 Claims, 6 Drawing Figures

FULL BODY HYDROMASSAGER HAVING AN ECCENTRIC WEIGHT ROTOR

BACKGROUND OF THE INVENTION

The instant invention relates generally to massaging devices and more specifically it relates to a full body massager apparatus.

Numerous massaging devices have been provided in prior art that are adapted to dispense vibratory impulses to the human form. While these units may be suitable for the particular purpose to which they address, they would not be as suitable for the purposes of the present invention as heretofore described.

SUMMARY OF THE INVENTION

A principal object of the present invention is to provide a full body massager apparatus that will overcome the shortcomings of the prior art devices.

Another object is to provide a full body massager apparatus that is held in the hand and rubbed over a persons body which is activated by water pressure from a water outlet whereby the water pressure will cause a vigorous vibration massaging effect as water passes through the apparatus over the persons body.

An additional object is to provide a full body massager apparatus in which the vibration massaging effect can be varied by an adjustment device therein.

A further object is to provide a full body massager apparatus that is economical in cost to manufacture.

A still further object is to provide a full body massager that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
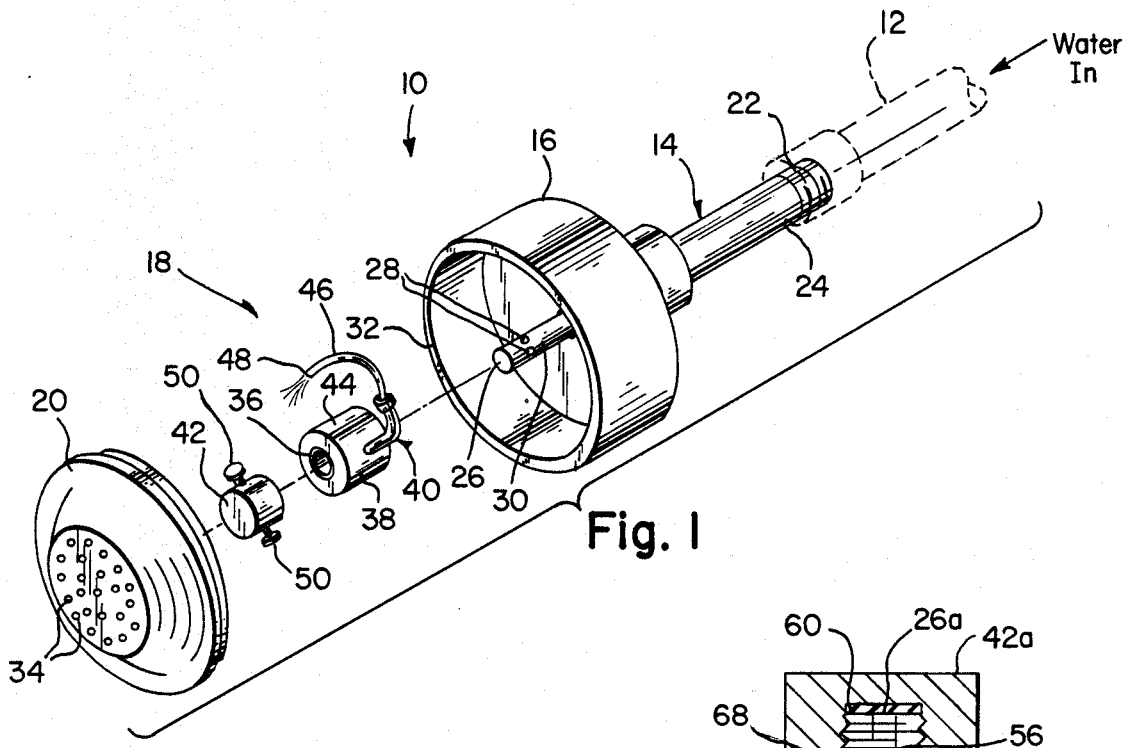
FIG. 1 is an exploded perspective view of the invention.
Figure 3:
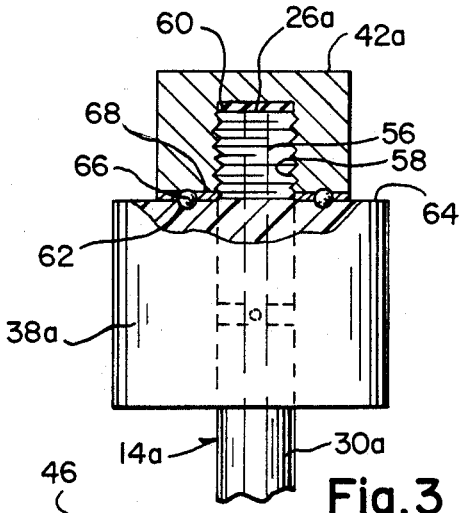
FIG. 3 is an enlarged detail view partly in cross section showing a modified end cap and rotor providing a gasket seat and bearings therebetween.
Figure 2:
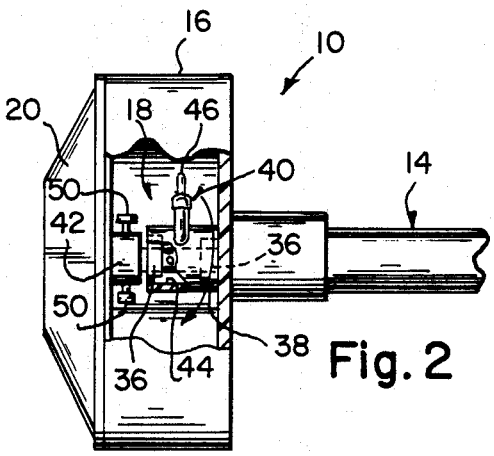
FIG. 2 is a side view with parts broken away.

Turning now descriptively to the drawings, in which similar reference characters denote similar elements throughout the several views, FIGS. 1 and 2 illustrate a full body massager apparatus 10 activated by water pressure from a water outlet (not shown) such as a sink or shower faucet.

The apparatus 10 consists of a flexible hose 12, a hollow shaft 14, a cylindrical housing 16, a vibrating device 18 and an end bell 20. The flexible hose 12 is fluidly coupled to the water outlet. The shaft 14 has external threads 22 at input end 24 and an opening 26 with outlet ports 28 at output end 30 in which the input end 24 is coupled to the flexible hose 12. The housing 16 has an open side 32 in which the housing is coupled to the hollow shaft 14 with the output end 30 extending therein.

The vibrating device 18 is for vibrating the apparatus 10 by the water pressure. The vibrating device 18 is coupled to the output end 30 over the outlet ports 28 of the hollow shaft 14. The end bell 20 has a plurality of holes 34 therein which snaps onto the open side 32 of the housing 16. When the hollow shaft 14 is held by a hand the end bell 20 can be rubbed over a persons body. The vibrating device 18 is activated by the water pressure from the water outlet in which the water pressure will cause a vigorous vibration massaging effect as water passes through the vibrating device 18 out of the holes 34 in the end bell 20 to the persons body.

The vibrating device 18 includes a pair of bearings 36, a rotor 38, an elbow fitting 40 and an end cap 42. The bearings 36 are coupled onto the output end 30 of the hollow shaft 14 between the outlet ports 28. The rotor 38 has a reservoir 44 within and is rotatably coupled onto the bearings 36. The elbow fitting 40 contains a curved jet tube portion 46 that has an orifice 48. The elbow fitting 40 is coupled through the reservoir 44 of the rotor 38. The end cap 42 is secured to the output end 30 of the hollow shaft 14 by set screws 50 to seal the opening 26. This allows the rotor 38 to turn with the elbow fitting 40 off center when the water exits the orifice 48 thus causing vibration.

Figure 4:
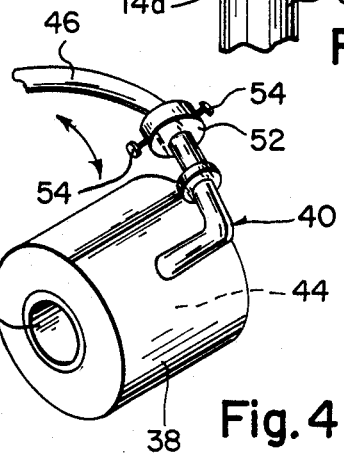
FIG. 4 is an enlarged perspective view of the rotor having a sliding weight for adjustment on the jet tube to vary the vibration effect.

FIG. 4 shows a weight 52 slidably coupled onto the jet tube portion 46 of the elbow fitting 40. Bolts 54 are for securing the weight 52 onto the jet tube portion 46 of the elbow fitting 40. Positioning of the weight 52 will increase and decrease vibration capabilities of the elbow fitting 40 on the rotor 38.

In FIG. 4 a modified end cap **42*a* is shown. The hollow shaft 14*a* has a second set of external threads 56 at the output end 30*a*. The end cap 42*a* has a well 58 with internal threads therein. A compressible rubber gasket 60 is placed within the well 58 of the end cap 42*a*. The rotor 38*a* has an annular raceway 62 formed in side 64 adjacent to the end cap 42*a*. Bearings 66 are formed on side 68 of the end cap 42*a* adjacent the rotor 38*a*. When the end cap 42*a* is threaded onto the threads 56 of the output end 30*a* of the hollow shaft 14*a*, the gasket 60 will seal the opening 26*a*. The bearings 66 will ride in the raceway 62 allowing the rotor 38*a*** to turn with the elbow fitting off center when the water exits the orifice thus causing vibration.

Figure 6:
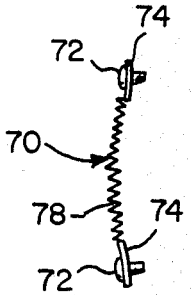
FIG. 6 is a side view of the finger holder.
Figure 5:
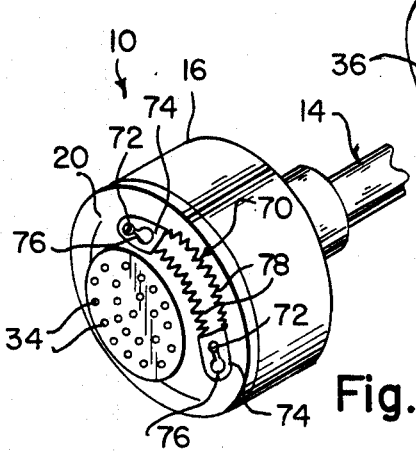
FIG. 5 is a perspective view of the invention with a finger holder attached thereto.

FIGS. 5 and 6 a finger holder 70 that consists of a pair of spaced apart truss head studs 72 mounted to the end bell 20 and a pair of stainless steel mounting plates 74. Each of the mounting plates 74 has a slot 76 with an enlarged opening so that the mounting plates can slide over the studs 72 to lock thereto. A pair of stainless steel springs 78 are affixed between the mounting plates 74 so that a person can extend their fingers between the springs 78 and the end bell 20 to hold the massager apparatus 10 thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A full body massager apparatus activated by water pressure from a water outlet which comprises:

(a) a flexible hose fluidily coupled to said water outlet;

(b) a hollow shaft with input and output ends having external threads at said input end and an opening with said outlet ports at output end, said input end coupled to said flexible hose;

(c) a cylindrical housing having an open side, said housing coupled to said hollow shaft with said output end extending therein;

(d) means for vibrating said apparatus by said water pressure, said vibrating means rotatably coupled to said output end over said outlet ports of said hollow shaft;

(e) an end bell having a plurality of holes therein, said end bell snaps onto said open side of said housing so that when said hollow shat is held by a hand said end bell can be rubbed over a persons body with said vibrating means activated by said water pressure from said water outlet in which said water pressure will cause a vigorous vibration massaging effect as water passes through said vibrating means out of said holes in said end bell to said persons body, wherein said vibrating means includes:

(f) a pair of bearings coupled onto said output end of said hollow shaft between said outlet ports;

(g) a rotor having a reservoir within, said rotor rotatably coupled onto said bearings;

(h) a elbow fitting with a curved jet tube portion having an orifice, said elbow fitting coupled through said reservoir of said rotor; and (i) an end cap secured to said output end of said hollow shaft to seal said opening and allow said rotor to turn with said elbow fitting off center when said water exits said orifice thus causing vibration further comprising:

(j) said hollow shaft having a second set of external threads at said output end;

(k) said end cap having a well with internal threads therein;

(l) a compressible rubber gasket placed within said well of said end cap;

(m) said rotor having an annular raceway formed in the side adjacent to said end cap; and (n) beaings formed on the side of said end cap adjacent said rotor so that when said end cap is threaded onto said threads of said output end of said hollow shaft, said gasket will seal said opening and said bearings will ride in said raceway allowing said rotor to turn with said elbow fitting off center when said water exits said orifice thus causing vibration.

2. A full body massager apparatus as recited in claim 1, further comprising a finger holder which comprises:

(o) a pair of spaced apart truss head studs mounted to said end bell;

(p) a pair of stainless steel mounting plates; each of said mounting plates having a slot with an enlarged opening so that said mounting plates can slide over said studs to lock thereto; and (q) a pair of stainless steel springs affixed between said mounting plate so that a person can extend their fingers between said springs and said end bell to hold said massager apparatus thereto.

* * * * *